US008757681B2

(12) United States Patent
Graute

(10) Patent No.: US 8,757,681 B2
(45) Date of Patent: Jun. 24, 2014

(54) MOTOR VEHICLE DOOR LOCK

(75) Inventor: Ludger Graute, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 523 days.

(21) Appl. No.: 13/119,554

(22) PCT Filed: Sep. 18, 2009

(86) PCT No.: PCT/DE2009/001319

§ 371 (c)(1),
(2), (4) Date: Apr. 20, 2011

(87) PCT Pub. No.: WO2010/034294

PCT Pub. Date: Apr. 1, 2010

(65) Prior Publication Data

US 2011/0187129 A1 Aug. 4, 2011

(30) Foreign Application Priority Data

Sep. 24, 2008 (DE) ..... 10 2008 048 772

(51) Int. Cl.
*E05C 3/06* (2006.01)
*E05B 65/12* (2006.01)
*E05C 3/00* (2006.01)

(52) U.S. Cl.
CPC ..... *E05B 81/14* (2013.01); *E05B 81/20* (2013.01)
USPC ..... 292/201; 292/216

(58) Field of Classification Search
CPC ..... E05B 81/14
USPC ..... 292/201, 216
See application file for complete search history.

(56) References Cited

U.S. PATENT DOCUMENTS

| | | | | | |
|---|---|---|---|---|---|
| 4,974,885 | A | * | 12/1990 | Yokoyama | 292/201 |
| 5,273,324 | A | * | 12/1993 | Kobayashi | 292/201 |
| 5,423,582 | A | * | 6/1995 | Kleefeldt | 292/201 |
| 5,516,164 | A | * | 5/1996 | Kobayashi | 292/201 |
| 5,613,716 | A | * | 3/1997 | Cafferty | 292/216 |
| 5,938,252 | A | * | 8/1999 | Uemura et al. | 292/201 |
| 6,079,237 | A | * | 6/2000 | Hochart | 70/278.6 |
| 6,279,972 | B1 | * | 8/2001 | Brill et al. | 292/216 |
| 6,505,867 | B1 | * | 1/2003 | Szablewski et al. | 292/201 |
| 6,659,515 | B2 | * | 12/2003 | Raymond et al. | 292/201 |
| 7,210,714 | B2 | * | 5/2007 | Berghahn et al. | 292/201 |
| 7,261,338 | B2 | * | 8/2007 | Spurr | 292/216 |
| 7,905,523 | B2 | * | 3/2011 | Stefanic et al. | 292/201 |

FOREIGN PATENT DOCUMENTS

| | | | | |
|---|---|---|---|---|
| DE | 19604724 | A1 * | 8/1997 | E05B 65/32 |
| DE | 199 33 371 | A1 | 2/2000 | |
| DE | 100 19 668 | A1 | 10/2001 | |
| EP | 1 319 780 | A1 | 6/2003 | |
| WO | 2005/075768 | A1 | 8/2005 | |

* cited by examiner

*Primary Examiner* — Carlos Lugo
(74) *Attorney, Agent, or Firm* — Konomi Takeshita

(57) ABSTRACT

A motor vehicle door lock, comprising a locking mechanism (3, 4) and a closing/opening device (5 to 8), containing at least a drive (5) and a lever actuating mechanism (6, 7, 8), wherein the lever actuating mechanism (6, 7, 8) in its engaged position is held by a non-actuated triggering lever (10) and it assumes its disengaged state upon activation of the triggering lever (10).

4 Claims, 3 Drawing Sheets

MOTOR VEHICLE DOOR LOCK

CROSS REFERENCE TO RELATED APPLICATIONS

This application claims priority under 35 U.S.C. 119 and 35 U.S.C. 365 based upon German Patent Application No. 10 2008 048 772.4, filed on Sep. 24, 2008.The entire disclosure of the aforesaid application is incorporated herein by reference.

FIELD OF THE INVENTION

The present invention relates to a motor vehicle door lock comprising a locking mechanism and a closing/opening device, containing at least one drive and a lever actuating mechanism.

BACKGROUND OF THE INVENTION

Closing/opening devices are generally used in motor vehicle doors for reasons of comfort and serve to either move a motor vehicle door into its fully closed position (main closing position) or to open it. Because of the not unsubstantial mechanical requirements and associated costs, closing/opening devices are at present predominantly reserved for expensive cars. As closing devices do, however, also increase safety, their general use in motor vehicles is being increasingly promoted.

In known embodiments, such as that disclosed in EP 1 319780 A1, the lever actuating mechanism is a complicated and expensive part of the closing/opening device. As a result, the entire lever actuating mechanism must be moved in case of an emergency interruption of the closing function. This is often rather uncomfortable for the operator. Children will also find it difficult to interrupt the closing process. The invention aims to remedy this situation.

SUMMARY OF THE INVENTION

The invention is based on the technical problem of further developing a motor vehicle door lock of the type described above in such a way that whilst providing a simple and cost-effective design of the closing/opening device it also offers the option of interrupting its function with little force.

In order to solve this technical problem, a motor vehicle door lock of the above type is provided in which the lever actuating mechanism in its engaged position is held by a non-actuated triggering lever and assumes its disengaged state upon actuation of the triggering lever.

In the engaged state a mechanically effective connection is provided between the drive and the locking mechanism. This means that the drive can move the locking mechanism into the desired position (in most cases the fully closed position or the primary position) by means of the lever actuating mechanism. In the disengaged state of the lever actuating mechanism, the mechanically effective connection is, however, interrupted. According to the invention, the triggering lever causes the lever actuating mechanism to change from the engaged state to the disengaged state.

The lever actuating mechanism is actually usually in the engaged position, if the triggering lever is not actuated. Upon actuation of the triggering lever, the lever actuating mechanism is moved into its disengaged state and at the same time, the mechanically effective connection between the drive and the locking mechanism is interrupted. As a result, the drive can not (can no longer) act on the locking mechanism and the closing/opening device becomes ineffective. Generally, the lever actuating mechanism consists of two parts, a supporting lever and a driving lever. Both the supporting lever and the driving lever are in most cases single-arm levers, containing a rotational axis at one end.

The rotational axis for the supporting lever is generally located in or on a frame box, housing the main elements of the motor vehicle door lock. The free end of the supporting lever remote from the axis is held between the (non-actuated) triggering lever and the driving lever. This can be achieved by the driving lever and the triggering lever both being equipped with stop pins between which the supporting lever is accommodated.

The supporting lever also generally contains an associated spring. The spring ensures that a force in the direction of the face of the driving lever acts upon the supporting lever. This ensures on the whole that the supporting lever supports or retains the driving lever in a position allowing the driving lever to make contact with the locking mechanism or with a rotary latch of the locking mechanism. The engaged state of the lever actuating mechanism corresponds to this.

When, however, the lever actuating mechanism is disengaged, as the triggering lever has been actuated, the driving lever ejects itself. In other words, the driving lever is designed to eject itself in the disengaged position of the lever actuating mechanism. For this purpose, one end of the driving lever is generally connected to the drive whilst its other end interacts with the locking mechanism. The self-ejecting effect is preferably achieved by the driving lever containing a stop face with a pre-cut or a bevel on its locking mechanism end.

The pre-cut or bevel are designed in such a way that a, in most cases obligatory, spring assigned to the locking mechanism ensures that the driving lever is directly ejected when the supporting or blocking effect of the supporting lever is removed as the triggering lever has been activated.

Generally, the triggering lever engages over the supporting lever and the driving lever in its non-actuated position. Upon actuation of the triggering lever, the supporting lever and the driving lever are not (no longer) fixed or retained by the triggering lever. This allows the rotary latch engaging in the pre-cut of the stop face and acted upon by the spring in the "open" direction, to eject the driving lever.

As a result, the stop face of the driving lever does not rest (no longer rest) against the locking mechanism and the closing/opening device is no longer effective. The lever actuating mechanism is now in its disengaged state.

The triggering lever causing the disengagement as a result of its actuation is generally a lock actuating lever. This lock actuating lever can be designed as an internal operating lever and/or external operating lever and/or main actuating lever. For the purpose of the invention, the main actuating lever refers to an actuating lever which is acted upon by the internal operating lever and the external operating lever. As usual, the internal operating lever is mechanically connected to an internal operating handle or an internal door handle, whilst an external door handle interacts with the external operating lever.

Operation of the internal door handle and/or of the external door handle causes, in any case, the lever actuating mechanism to be disengaged and the driving lever or a driving pawl used at this point to be released from the locking mechanism, because it is ejected. As a result, the locking mechanism returns to its intermediate closed position if the motor vehicle door lock is in the "locked" position or even assumes the open position. This applies if the motor vehicle door lock is in the "unlocked" position.

In any case the simple activation of the triggering lever or of the lock actuating lever provided at this point fully suffices to disengage the lever actuating mechanism and consequently interrupt the mechanically effective connection between the drive and the locking mechanism. This process is normally associated with an emergency interruption, when for instance during a door-closing operation an object or hand becomes jammed between the door and car body.

In this situation, an immediate activation of the external door handle and/or of the internal door handle causes the closing process to be instantly interrupted and ensures that depending on the position of the motor vehicle door lock (unlocked or locked) the respective motor vehicle door lock can be fully opened or that at least no further closing movement (is no longer) carried out. The same generally applies in the event that instead of a closing force an opening force is acting upon the motor vehicle door. All in all only minimum operating forces are required that can also be exerted without problem by a child. These are the main advantages of the invention.

Below, the invention is explained in more detail with reference to the accompanying, exemplary drawings showing only one embodiment, as follows:

Figure 1:
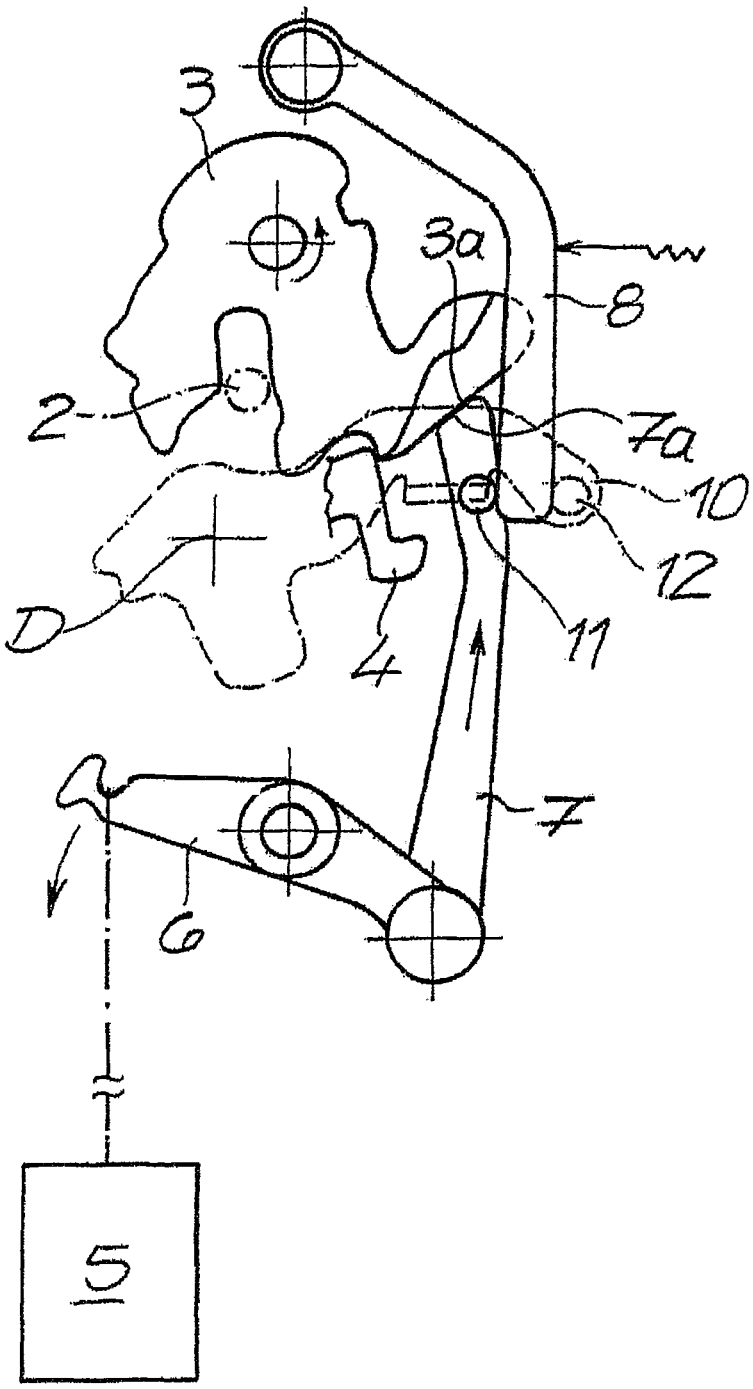
FIG. 1 shows the motor vehicle door lock of the invention with an engaged lever actuating mechanism and locking mechanism in the intermediate closed position.

Other features and advantages of the present invention will become apparent from the following detailed description, taken in conjunction with the accompanying drawings which illustrate, by way of example, the principles of the invention.

DETAILED DESCRIPTION OF THE INVENTION

The figures show a motor vehicle door lock comprising mainly a motor vehicle door lock 1 and an only indicated locking bolt 2, interacting therewith.

The motor vehicle door lock 1 or the motor vehicle door closure contains an usual locking mechanism 3, 4 comprising a rotary latch 3 and a pawl 4. In addition an only schematically indicated drive 5 is provided, defining a closing/opening device 5 to 8 together with the lever actuating mechanism 6, 7, 8. In the embodiment, the closing/opening device 5 to 8 is designed as a closing aid 5 to 8.

Figure 3:
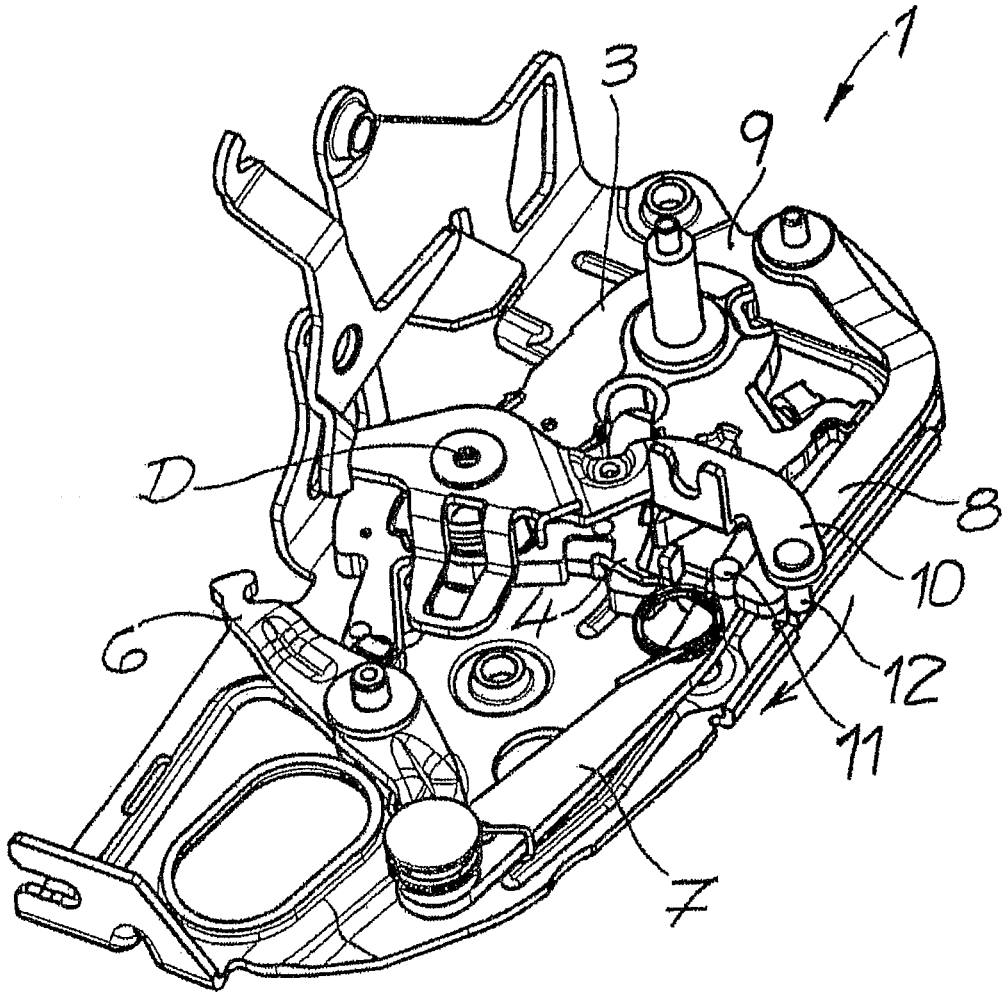
FIG. 3 shows a perspective view of the overall motor vehicle door lock with the locking mechanism being in the fully closed position.

In the drawing shown in FIG. 1, the lever actuating mechanism 6, 7, 8 is in the engaged position and provides a mechanically effective connection between the drive 5 and the locking mechanism 3, 4. In fact, the pulling force of a transmission lever 6 via a Bowden cable provided at the end of the drive 5 in the direction indicated by the arrow in FIG. 1, causes a driving lever 7 connected to the transmission lever 6 to abut against the rotary latch 3 of the locking mechanism 3, 4. This causes the rotary latch 3 and thus the locking mechanism 3, 4 to move from the intermediate closed position of FIG. 1 to the fully closed position or primary position shown in FIG. 3. During this process, the rotary latch 3 is moved anti-clockwise as shown by the respective arrow. Naturally, also another connection means than the Bowden cable can be used between the drive 5 and the transmission lever 6.

In FIG. 1 the locking mechanism 3, 4 is in the intermediate closed position or first position, in which the pawl 4 has engaged in a first position of the rotary latch 3 as is usual for such an arrangement. This position is initiated or achieved by the locking bolt 2 moving into an opening in the rotary latch 3 during closing of the vehicle door, pivoting the rotary latch 3 anti-clockwise into the first position. As soon as this position has, for instance, been detected by, for instance, a sensor inside the motor vehicle door lock 1, the drive 5 is acted upon, as described.

This means that the driving lever 7 as shown in FIG. 1 is moved vertically upwards in the direction of the arrow by means of the drive 5 and the transmission lever 6, so that it abuts with a stop face 7*a* against the rotary latch 3 or a stop face 3*a* thereof and moves the rotary latch 3 anti-clockwise into the fully closed position or primary position. That is the normal operation during a closing process.

During this process, the driving lever 7 is guided by a supporting lever 8, so that the two stop faces 7*a*, 3*a* remain engaged on the driving lever 7 and on the rotary latch 3. In fact the driving lever 7 and the supporting lever 8 are each single-arm levers. One end of the driving lever 7 is arranged in a rotational axis on the transmission lever 6, whilst the other end contains said stop face 7 a.

The supporting lever 8 contains a rotatable bearing in a rotational axis at one end, which is defined in a frame box 9. The other free end is held between a triggering lever 10 and the driving lever 7. For this purpose, the driving lever 7 and the triggering lever 10 contain stop pins 11, 12. The supporting lever 8 is arranged between stop pins 11 on the driving lever 7 and stop pins 12 on the triggering lever 10 in the "non-actuated or not activated" position of the triggering lever 10.

The driving lever 7 and also the supporting lever 8 are, however, disengaged from the triggering lever 10 when said lever is actuated. This actuation corresponds to the triggering lever 10 pivoting clockwise around its rotational axis D arranged in the frame box 9, as indicated by the arrow in FIG. 3.

The basic arrangements also includes a spring—only indicated—acting upon the supporting lever or blocking lever 8 with a force in the direction of the driving lever 7. A further spring, not expressly shown, ensures that the locking mechanism 3, 4 or its rotary latch 3 is acted upon in the direction of the "open" position. A force acting clockwise on the rotary latch 3 (see arrow in FIG. 2) corresponds to this. This means that during the closing process, the spring acts in the opposite direction to the movement of the rotary latch 3 (anti-clockwise).

The arrangement functions as follows. In FIG. 1 the motor vehicle door lock 1 is in the first position and the triggering lever 10 is not actuated. The locking mechanism 3, 4 has assumed this first position as the locking bolt 2 has moved into an opening of the rotary latch 3 and has moved the rotary latch 3 anti-clockwise to such an extent that the position shown in FIG. 1 with the pawl 4 in the first position, has been reached. As soon as this is the case, the drive 5 is activated.

The drive 5 acts, for instance, via a Bowden cable arranged on the outside or generally a flexible connection element on the transmission lever 6 moving said lever with a vertical force at one of its ends downwards, as indicated by the arrow. This causes the other end of the two-arm transmission lever 6 to be moved upwards, which then also applies to the driving lever 7, rotatably arranged on the transmission lever 6. As a result, the stop face 7*a* of the driving lever 7 directly abuts against the rotary latch 3 (stop face 3*a*) moving the rotary latch 3 anti-clockwise into its primary position (see FIG. 3).

As soon as the primary position has been reached, the motor or drive 5 is stopped. This is the usual operation of the closing function. During the entire time the triggering lever 10 has naturally not been actuated, as the vehicle door is to be closed and not opened.

If due, to for instance, a blockage of the vehicle door to be closed or for any other reason the closing operation has to be interrupted, a so-called emergency interruption is initiated and defined by the actuation of the triggering lever 10. The actuation of the triggering lever 10 and the respective pivoting in clockwise direction around the rotational axis D is regularly initiated by pulling of the internal door handle and/or external door handle. This process of an emergency interruption with an opening rotary latch 3 is shown in FIG. 2.

Figure 2:
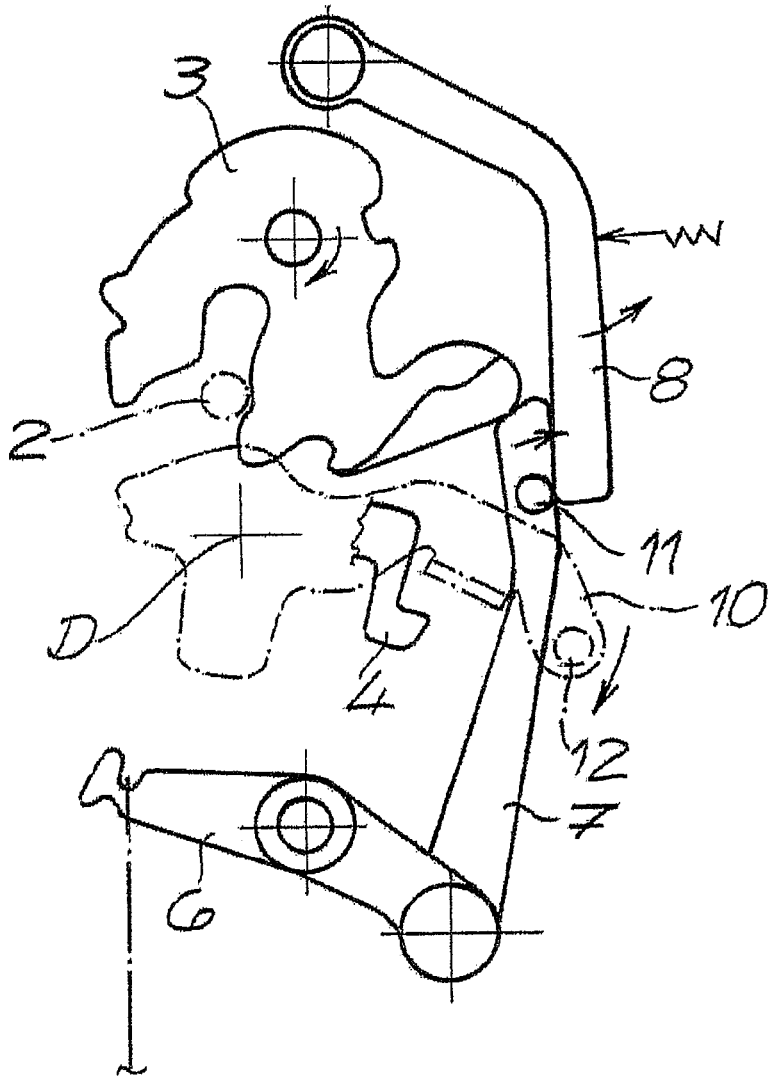
FIG. 2 shows the object of FIG. 1 in the "disengaged" position of the lever actuating mechanism during an emergency interruption.

As a result, the triggering lever 10 can no longer engage over the supporting lever 8 and the driving lever 7 and thus retain them in their position, as shown in FIG. 2. Because as soon as the triggering lever 10 is actuated, this corresponds to the disengaged state of the lever actuating mechanism 6, 7, 8. The driving lever 7 is itself ejected in this disengaged state of the lever actuating mechanism 6, 7, 8.

This occurs in such a way that the driving lever 7 connected with one end to drive 5 and with its other end interacting with the locking mechanism 3, 4 is ejected by the force of the locking mechanism 3, 4. This means that the spring assigned to the locking mechanism 3, 4 acts upon the rotary latch 3 (in clockwise direction) in the "open" position.

As the stop face 7*a* of the driving lever 7 contains a pre-cut or a bevel, said spring acting rotationally (in clockwise direction) on the rotary latch 3, ensures that the driving lever 7 is pushed away from the locking mechanism 3, 4 or the stop face 3*a* on the rotary latch 3. During this process of self-ejection, the supporting lever 8 is carried along and against the force of its spring. This is due to the fact that the force of the spring assigned to the locking mechanism 3, 4 exceeds the force exerted by the spring of the supporting lever 8 and that the door seal pressure also pushes open the rotary latch 3.

The driving lever 7 is thus moved upon actuation of the triggering lever 10, i.e. by the force of the spring belonging to the locking mechanism 3, 4, the door counter pressure and optionally by a supporting lever 8 being carried along. The driving lever 7 is thus self-ejecting as soon as the lever actuating mechanism 6, 7, 8 assumes its disengaged state whilst the triggering lever 10 is actuated. The actuation of the triggering lever 10 is—as described above—initiated by an activation of an internal and/or external door handle.

It is to be understood that the above-described embodiment is illustrative of only one of the many possible specific embodiments which can represent applications of the principles of the invention. Numerous and varied other arrangements can be readily devised by those skilled in the art without departing from the spirit and scope of the invention.

What is claimed is:

1. A motor vehicle door lock, comprising:

a locking mechanism (3, 4) and a closing/opening device (5 to 8), containing at least a drive (5) and a lever actuating mechanism (6, 7, 8), containing at least two parts, a supporting lever (8) and a driving lever (7), wherein the lever actuating mechanism (6, 7, 8) in an engaged position is held by a non-actuated triggering lever (10) and it assumes a disengaged state upon activation of the triggering lever (10), wherein the non-actuated triggering lever (10) engages over the supporting lever (8) and the driving lever (7), wherein the triggering lever (10) is designed as a lock actuating lever, designed as at least one of an internal operating lever, an external operating lever and a main actuating lever, and the triggering lever (10) is mechanically connected to an internal operating/door handle and/or an external door handle, and wherein an operation of the internal operating/door handle and/or the external door handle actuates the triggering lever (10).

2. The motor vehicle door lock according to claim 1, wherein the supporting lever (8) is a single-arm lever and wherein a free end of the supporting lever (8) remote from its axis is being held between the triggering lever (10) and the driving lever (7).

3. The motor vehicle door lock according to claim 1, wherein the supporting lever (8) contains an assigned spring acting upon it in a direction of a face of the driving lever (7).

4. The motor vehicle door lock according to claim 1, wherein the driving lever (7) and the triggering lever (10) each contain the supporting lever (8) between accommodating stop pins (11, 12).

* * * * *